United States Patent [19]

Lessard

[11] 4,275,826

[45] Jun. 30, 1981

[54] PANTS RACK

[76] Inventor: Roy W. Lessard, 2Greenbriar Cir., Hagerstown, Md. 21740

[21] Appl. No.: 11,958

[22] Filed: Feb. 13, 1979

[51] Int. Cl.[3] ..... A47F 7/16; A47J 51/14

[52] U.S. Cl. ..... 223/96; 248/316 F; 211/89

[58] Field of Search ..... 211/89, 124; 223/96, 223/90, 91; 248/316 B–316 F, 309 R; 24/263 SW, 244

[56] References Cited

U.S. PATENT DOCUMENTS

| | | | |
|---|---|---|---|
| 1,417,009 | 5/1922 | Woodward | 248/316 F |
| 1,613,354 | 1/1927 | Mathes | 223/96 |
| 1,997,490 | 4/1935 | Hoar | 211/124 X |
| 3,312,379 | 4/1967 | Gunzberg | 223/96 |
| 3,325,134 | 6/1967 | Henry | 248/316 F X |
| 3,399,429 | 9/1968 | Goodman | 248/316 F X |
| 3,435,999 | 4/1969 | Mantell | 223/91 |
| 3,591,013 | 7/1971 | Herrmann | 248/316 F X |
| 3,893,570 | 7/1975 | Vogt | 223/96 X |
| 4,085,848 | 4/1978 | Tsuge | 248/316 F X |

FOREIGN PATENT DOCUMENTS

| | | | |
|---|---|---|---|
| 2343718 | 3/1975 | Fed. Rep. of Germany | 211/89 |
| 183046 | 7/1922 | United Kingdom | 223/96 |

*Primary Examiner*—Werner H. Schroeder
*Assistant Examiner*—Andrew M. Falik

[57] ABSTRACT

A rack having a longitudinal base member with longitudinal flexible material holding member such as a pair of pants secured to the side of the base member by pivotal connection at one end of the holding member allowing the pair of pants to be inserted through the opening between the other end of the holding member and base member. A wedge bracket is located near the pivotal end of base member which forces the holding member against the base member thereby providing a pants gripping force when the pants weight rotates the holding member down.

2 Claims, 3 Drawing Figures

PANTS RACK

BACKGROUND OF THE INVENTION

There are known pants supporting devices, such as the well known clothes hanger or the pants supporting device having a pair of spring biased members that grip the pants just above the cuffs of the pants to support the pants in a vertical inverted position. It is well known to those who have used the known pants supporting devices and clothes hangers, that these devices have many disadvantages. Pants tend to slip off the horizontal member of a clothes hanger. Further the horizontal member is connected at each end and unless there is adequate width dimensions, the side member causes folds in the edges of the pants. Also, it is difficult to correctly align the creases in the pants and then position the pants with the creases aligned on the horizontal bar of the clothes hanger. The other known pants supporting devices, such as the devices using the spring biased members, have the disadvantage of allowing the pants to slide therethrough forcing the cuffs against the support. This creases folds into the cuffs in an undesirable manner. Still further, many pants today are made without cuffs and are thus difficult to support on the known pants supporting devices.

Thus is advantageous to have a new pants rack that supports pants in the manner that the pants are not creased by the supporting means, that is easy and simple to construct and operate, that can be permanently installed easily and inexpensively in fixed positions, that securely holds the pants whether they have cuffs or not in a supported position, and on which pants rack it is easy to place the pants with the creases aligned.

SUMMARY OF THE INVENTION

The embodiment of this invention comprises a base member having a longitudinal and substantially rectangular shape. A longitudinal round rod pants holding member—is pivotally supported at one of its ends to the base member such that holding member extends longitudinally along the side. A wedge bracket located near the pivotal end of the base member is shaped to provide a mechanical locking force.

The invention incorporates a new method of hinging a longitudinal pants holding member at one end such that pants may be easily draped and removed from such support. The invention provides a simple mechanical system whereas the pants weight provides the frictional locking force and thereby prevents slippage of pants with and without cuffs.

The basic concept is to provide a longitudinal holding member, hinged at one end, that can be rotated up to allow pants to be slipped easily over the open end. The weight of the pants is then utilized to rotate the longitudinal holding member down and into a locked position. As the longitudinal holding member is rotated down, it makes contact with a wedge bracket which provides a high force moving the longitudinal holding member toward the base support member thereby locking the pants in place.

The base member may be fastened permanently to walls such as in hotels or motels to prevent removal, or supported by other typical well known wire and wood hanging devices at a point substantially corresponding to its center of gravity so that the structure hangs in a substantially horizontal position.

Thus it is the object of this invention to provide a new and improved pants rack that will support pants of any style and not allow them to slip off.

It is another object of this invention to provide a new and improved pants rack that is simple in operation, is inexpensive to construct, is durable in construction, and that does not require springs or other resilient members for its operation.

It is another object of this invention to provide a new and improved pants rack that can be either supported conventionally by hangers or permanently fixed to walls.

It is of course envisioned that the scope of the invention encompasses not only a means to support a pair of pants but also any flexible material which will drape over the longitudinal holding member.

Other objects and many intended advantages of this invention will become more apparent upon reading the following detailed description and examining the drawing which:

DETAILED DESCRIPTION OF THE INVENTION

There are three critical elements associated with this invention.

Figure 1:
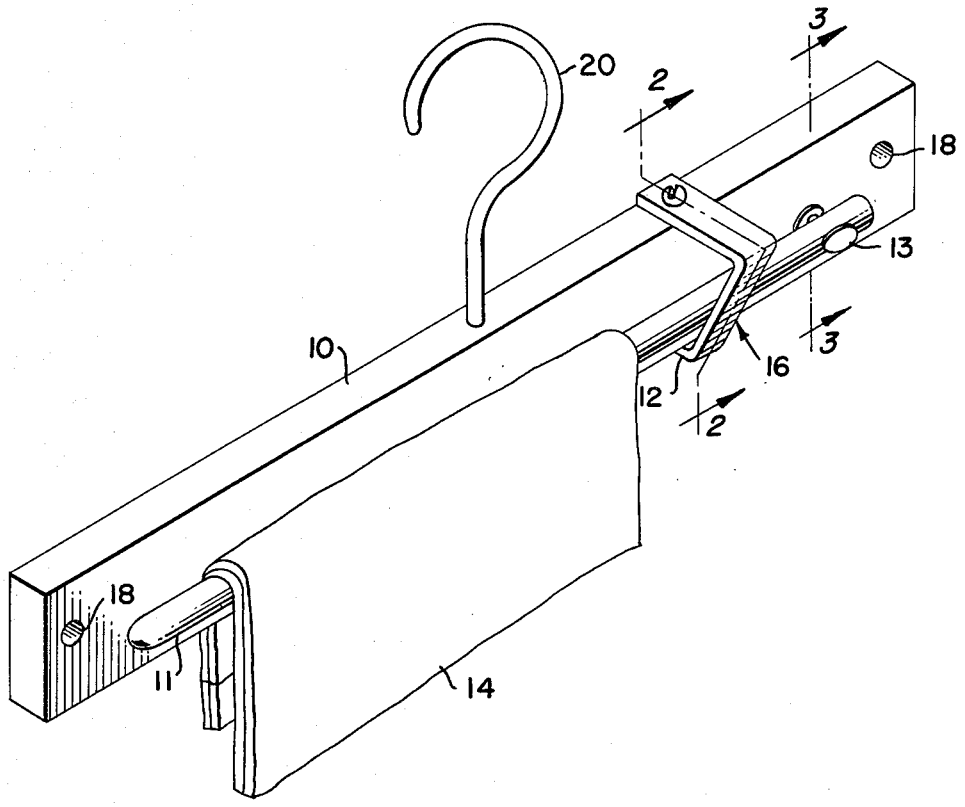
FIG. 1 is a perspective view of the embodiment of the invention showing a longitudinal pants holding member secured and hinged to a base support member.

10—BASE SUPPORT MEMBER: The base support member is a rectangular section that provides the base for hinging the longitudinal holding member. It may be fastened permanently to a wall as shown in FIG. 1 utilizing mounting holes 18, or supported by various hangers and hanging devices as shown by hanger 20.

11—LONGITUDINAL PANTS HOLDING MEMBER: This member is a round rod, hinged at one end, over which the pants are draped.

12—WEDGE BRACKET: This bracket is attached to the base support member and because of its shape provides a force which locks the draped pants between the longitudinal holding member 11 and base support 10.

Figure 3:
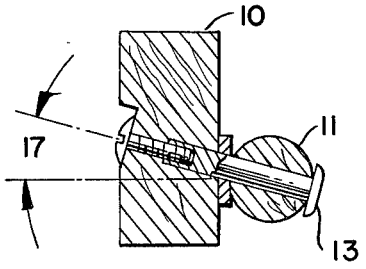
FIG. 3 is a sectional view showing the pin which hinges the longitudinal holding member to the base member.

In operation, the longitudinal holding member 11 is first rotated up about pin 13. As shown in FIG. 3, the hinge pin 13 is set at an angle 17 which makes member 11 pivot up and away from support member 10, thereby creating gap 15 between members 11 and 10.

A pair of pants 14 is then easily inserted from one end and draped over longitudinal holding member 11 using gap 15 created by the upper rotation of member 11.

Figure 2:
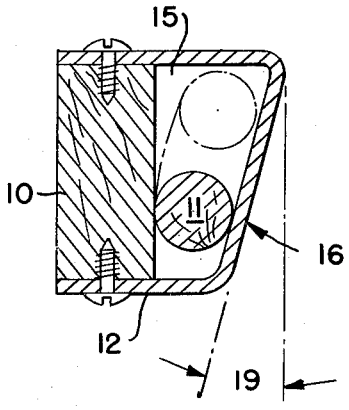
FIG. 2 is a sectional view showing the wedge bracket which generates the locking force.

The weight of the draped pants now rotates the longitudinal holding member 11 about hinge pin 13. The downward rotation causes the wedge bracket 12 to create a force at a location 16 in FIG. 2 between members 11 and 10 due to wedge angle 19, which prevents pants slippage and increases as pants weight increases.

Removal of pants 14 is accomplished by raising the longitudinal member 11 and simply sliding pants 14 off the open end of member 11.

Having disclosed my invention I now claim a pants rack comprising:

1. A longitudinal member for holding a flexible material attached at one end to a base support member by a hinge pin and supported thereon to rotate in a plane substantially parallel to said base support wherein said base support member includes a wedge type bracket at a location near said hinge pin to cause said longitudinal member upon being rotated downwardly by the weight of said flexible material hanging thereon to simultaneously move inwards towards the base support and thereby wedge said material between itself and said base support.

2. A system described in claim 1 having a base support member that can be securely bolted to walls such as in motels or supported by other conventional hanger systems.

* * * * *